United States Patent [19]

Ramakrishnan et al.

[11] Patent Number: 4,941,901

[45] Date of Patent: Jul. 17, 1990

[54] RETROFIT DRAINAGE TROUGH FOR INSTALLATION ON PRE-EXISTENT CABINET CONTAINED, WALL SUPPORTED AIR CONDITIONERS

[75] Inventors: Rengaswamy Ramakrishnan; Michael D. Callaway, both of San Antonio, Tex.

[73] Assignee: U.S. Natural Resources, Inc.,, San Antonio, Tex.

[21] Appl. No.: 376,699

[22] Filed: Jul. 7, 1989

[51] Int. Cl.[5] ..... F25D 23/12

[52] U.S. Cl. ..... 62/262; 62/272; 62/285

[58] Field of Search ..... 62/262, 272, 285

[56] References Cited

U.S. PATENT DOCUMENTS

| | | | |
|---|---|---|---|
| 3,000,192 | 9/1961 | Mullen et al. | 62/285 |
| 3,035,421 | 5/1962 | Halbeisen | 62/262 X |
| 3,035,422 | 5/1962 | Halbeisen | 62/262 X |
| 3,367,132 | 2/1968 | Elliott | 62/285 |
| 3,724,233 | 4/1973 | Pugh et al. | 62/285 |
| 4,416,327 | 11/1983 | Nakada et al. | 165/122 |
| 4,513,586 | 4/1985 | Jennings et al. | 62/263 |
| 4,766,738 | 8/1988 | Ebata | 62/280 |
| 4,793,147 | 12/1988 | Cho | 62/285 X |

*Primary Examiner*—Lloyd L. King

*Attorney, Agent, or Firm*—Gunn, Lee & Miller

[57] ABSTRACT

A clip-on retrofit drainage tray or trough is disclosed. The device has a full width tray fitting at the exposed back edge of a window unit or through-the-wall air conditioner, and is located just below the bottom of the sleeve to catch condensate. The dripping water is drained into the trough and out through a drain hole formed in the trough. The trough has an overhead clip attaching on a lip above the sleeve bottom.

11 Claims, 2 Drawing Sheets

RETROFIT DRAINAGE TROUGH FOR INSTALLATION ON PRE-EXISTENT CABINET CONTAINED, WALL SUPPORTED AIR CONDITIONERS

BACKGROUND OF THE DISCLOSURE

A wall mounted or room air conditioner/heat pump is typically constructed as an outer sleeve and a chassis (two pieces) which are adapted to be installed either in a window or through a wall opening. At one end, it is cosmetically attractive to extend into the room which is to be cooled or heated during operation. The opposite end is exposed to the exterior for heat rejection or heat pickup.

In accordance with known cooling operation, heat is taken from the room and rejected out through the back end of the cabinet or case through a condenser. This cabinet is normally described as a sleeve, referring to the surrounding rectangular metal container. The sleeve contains a chassis which can slide in and out of the sleeve. The bottom side of the chassis will be described hereinafter as the "pan." It is a pan especially in the sense that it collects liquid condensate. During the routine operation of the air conditioner, excess humidity in the room air is removed. This humidity is converted into condensate, collecting on a coil within the air conditioner and it is guided or directed by gravity, dripping onto the pan and towards the back end of the pan. It sometimes drips off the back end of the pan to the exterior of the building, when the condensate removal is excessive.

Certain problems arise from the dripping water. It incessantly keeps the surface areas below the window or wall opening wet. If the structure is wood construction, or if there is any area which is susceptible to accelerated rotting when wet, undue damage can arise as a result of the water flow. The possibility exists that the window casement or wooden framing may rot completely away and require extensive carpentry repair. Moreover, as the water runs down the side, even should the side of the building be water resistant, the water will collect pigments, and discolor the surface area. It can take on any color from a stained dirty brown to a green mold color, all to the detriment and harm to the building which is being air conditioned. It is with this problem, in the background that the present apparatus is set forth.

It is sometimes difficult to service such window or wall unit air conditioners. They are typically constructed so the chassis can be withdrawn into the room. If the room is at ground level, service personnel can approach from the exterior quite readily. If, however, the unit is mounted either high in a ground level room or in a multistory structure, gaining access to the exterior wall is quite difficult. Such access cannot be readily obtained without ladders or scaffolding. Accordingly, it is highly desirable that the condensate which travels on the gently sloping pan be guided to the exterior and directed away from the supporting wall and other structures so that condensate disposal is easily accomplished, preferably through a drain tube.

The present apparatus is a retrofit device which can be installed without requiring external access to the window air conditioning unit. It clips to a lip which is incorporated on the bottom exterior of the sleeve. For purposes of efficient heat rejection, there is a louvered or screened panel at the back end of the air conditioner.

Heat rejection is caused by air flowing over the condenser and then through this panel. This panel is removed to expose the lip on the bottom exterior of the sleeve. The present apparatus clips to that lip and is therefore installed easily after withdrawing the window unit into the room. The unit can be quickly withdrawn from the fixed sleeve into the room, the louvered panel removed, the present invention installed on the outside edge (lip) of the sleeve, and thereafter the window air conditioner is repositioned in the sleeve opening, along with the louvered panel. The louvered panel secures the present invention in place.

The present apparatus, when installed, does not change the dimensions of the sleeve or unit, so that the unit is easily reinstalled into the same opening. For this reason, it is particularly helpful after easy installation to guide and direct the collected condensate away from the building. This reduces damage from rotting, mildew, or fungus on the building. It also avoids the unsightly stains. It further reduces building maintenance by avoiding the necessity of repainting and the like.

Patent references which set forth structures known heretofore include:

| Pat. No. | Inventor |
|---|---|
| 4,513,586 | Jennings et al. |
| 4,416,327 | Nakada et al. |
| 3,000,192 | Mullin et al. |
| 4,766,738 | Ebata |
| 3,724,233 | Pugh, et al. |

The most material of the foregoing references is the '586 patent. This discloses a combination compressor support with a drain pan which has a drain bracket. It is used to collect and dispose of condensate from operation of the air conditioning equipment. In particular, it collects and diverts the condensate out through the protruding pan which is attached by a set of screws as detailed fully therein. A gusset 64 also functions as a mounting bracket and has a drain passage therethrough.

The apparatus of the present disclosure sets forth a mechanism which is affixed to the pre-existent window or wall air conditioning unit without requiring modification and the device is attached by latching into the sleeve lip just at the edge of the pan. The present apparatus has been summarized briefly above, but a better understanding of this apparatus will be obtained upon a review of the drawings which are incorporated below, and which relate to the detailed description set forth in the specification.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

DETAILED DESCRIPTION OF THE PREFERRED EMBODIMENT

Figure 1:
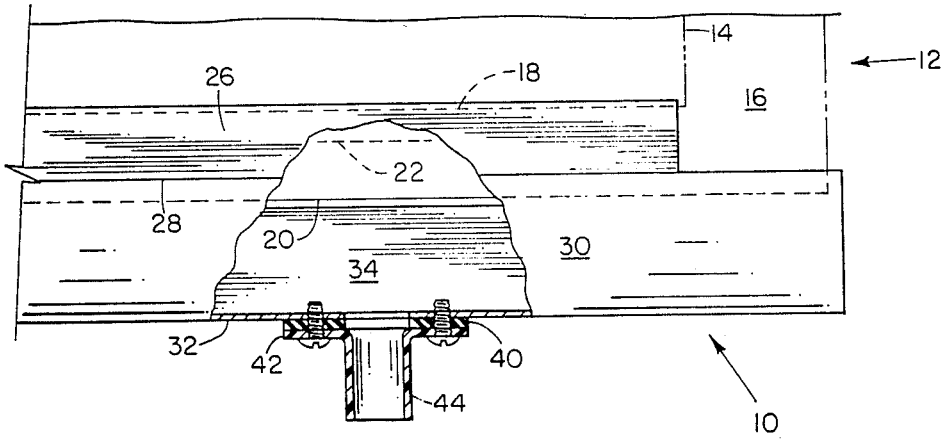
FIG. 1 is a front view of the retrofit apparatus of this disclosure shown installed on the sleeve of a window air conditioning unit, with a portion broken away to show a drained opening therein.

Attention is first directed to FIG. 1 of the drawings where the numeral 10 identifies the retrofit apparatus of this disclosure installed on a window air conditioning sleeve 12. The air conditioning sleeve 12 is constructed to fit within an opening of a building (not shown) which supports the air conditioning unit with the heat rejection occurring out through the back end of the air conditioning sleeve. The air conditioning unit is constructed also with a louvered opening 14. This opening is covered with a grill or the like. A fan (not shown) within the air conditioning equipment blows hot air out through this opening, in cooling operation.

This opening 14 defines a marginal lip or area 16 which encircles the opening on the sides. Moreover, the opening 14 terminates at a lower edge 18 that is parallel to the bottom of the sleeve 20 as shown in FIG. 1. As will be observed, the retrofit accessory of the present disclosure has been partly broken way to provide better illustration of its installation on the air conditioning sleeve 12.

The present invention may be sized to fit various models of air conditioning units. Since these dimensions are fixed, the present apparatus may find ready adaptability for installation on a number of different types and models of air conditioning units. To this end, they are all handled in the same fashion so that installation is done in the same way. Therefore, this installation approach can be used for practically all such air conditioning units. Accordingly, the accessory of this disclosure is a water drainage accessory which releasably clips onto the sleeve in the fashion set forth below.

The accessory 10 is typically stamped out of sheet metal stock (or formed from plastic) which is painted or coated to prevent rust or decay. This forms a sheet metal trough. This is better shown in FIG. 2 of the drawings. There, the clip-on accessory has a back lip 22 which is creased at 24. It has a vertical member or top portion 26 extending below the crease 24. There is a bend, in the range of about 20 to 40 degrees, located at 28 which positions a front face 30 at about a 30° angle from the top portion 26. The front face at 30 is part of the trough which collects condensate as will be described. It is likewise bent at the bottom edge 31 to define a bottom 32. The bottom also supports a bent upstanding back wall 34. Going to FIG. 1 of the drawings, front walls created by the top portion 26 and front face 30 provide almost a continuous exposed area that supports the trough. Moreover, the trough extends to the rear so as to be located beneath the bottom of the sleeve 20. Assuming that the apparatus is formed of a sheet metal (or the like) stamping, it is formed with folded end walls such as the end wall 36 shown in FIG. 2. This is folded over in a transverse direction to close off the end of the trough. As necessary, a sealant such as silicon, or other caulking material, is placed in the corners around the end walls 36 to prevent leakage. If plastic, the end walls are molded in and sealing is not necessary. This assures construction of a leak-proof trough so that condensate is captured.

In the ordinary operation of the air conditioning unit, condensate is formed in the inside portions of the air conditioning unit and flows by gravity downwardly and accumulates in the back of the pan above the sleeve bottom 20. The units are constructed so that the unwanted condensate is directed by gravity on a gentle slope towards the rear of the air conditioning unit. Excessive condensate causes the water to drip onto and off the sleeve bottom 20. Moreover, that causes the water to be directed into the trough. It collects in the trough and is removed through an opening in the trough. For easy connection with a drain tube, the preferred embodiment 10 incorporates a drain hole. More specifically, an internal resilient material gasket 40 is glued or otherwise attached in the trough, though it is not necessary. It has a hole which aligns with an equal sized hole through the trough bottom 32. A similar gasket 42 may be located on the nether side, although it is not required. The gasket 42 supports a nipple 44 for easy attachment of a tubing hose or the like. Gasket 42 and nipple 44 may be combined into one piece, which can be plastic. The gaskets 40 and 42 are installed either with an adhesive or, alternately, with mounting screws. If screws are used, they preferably are pulled tight so that the resilient material comprising the gaskets 40 and 42 seals against leakage at that location. This provides a downward drain subsequently removing the condensate. As required, the drain just described can be located at two or three locations along the length of the apparatus.

For installation, it should be noted that the removable retrofit attachment 10 has different lengths in contrasting the top and bottom edges. The front face 30 is equal in length to the width of the air conditioning unit. This enables the back edge of the sleeve bottom 20 to be enclosed within the trough so that the trough extends slightly over the ends and captures that portion of the sleeve edge. By contrast, the louvered opening is shorter in width, and therefore the top portion 26 is shorter. It is shorter at each end to accommodate the marginal area 16. Moreover, this arrangement assures that the clipping action for attachment is easily accomplished. The air conditioning louvered opening has a specified width, and the back lip 22 which affixes the retrofit apparatus 10 is sized so as to be slightly less in linear dimension. It is installed simply by hand guidance to assure that the back lip 22 overhangs and captures the top edge at the louvered opening.

Figure 2:
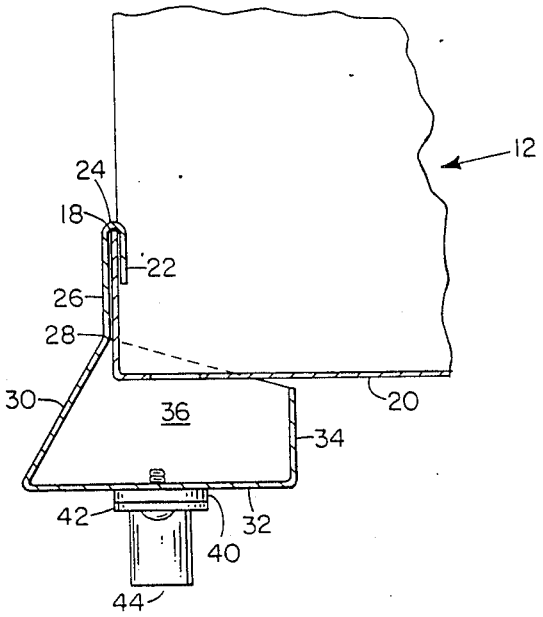
FIG. 2 is an end view of the retrofit apparatus of FIG. 1 showing clipping of this apparatus over a portion of the sleeve of the window air conditioning unit wherein installation is accomplished by hand, without any tools.
Figure 3:
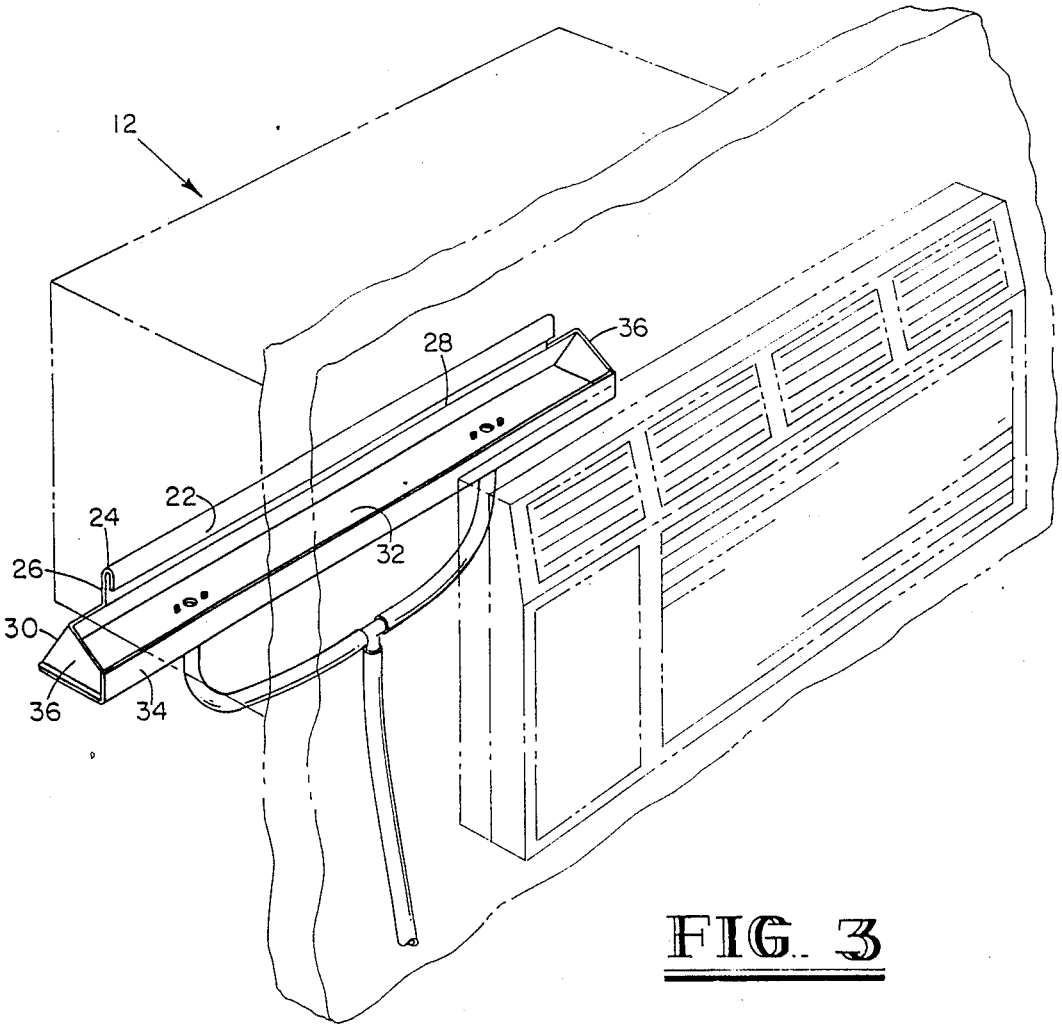
FIG. 3 is a perspective view of the apparatus in place on the sleeve of the air conditioning unit, showing an optional embodiment with two drains.
Figure 4:
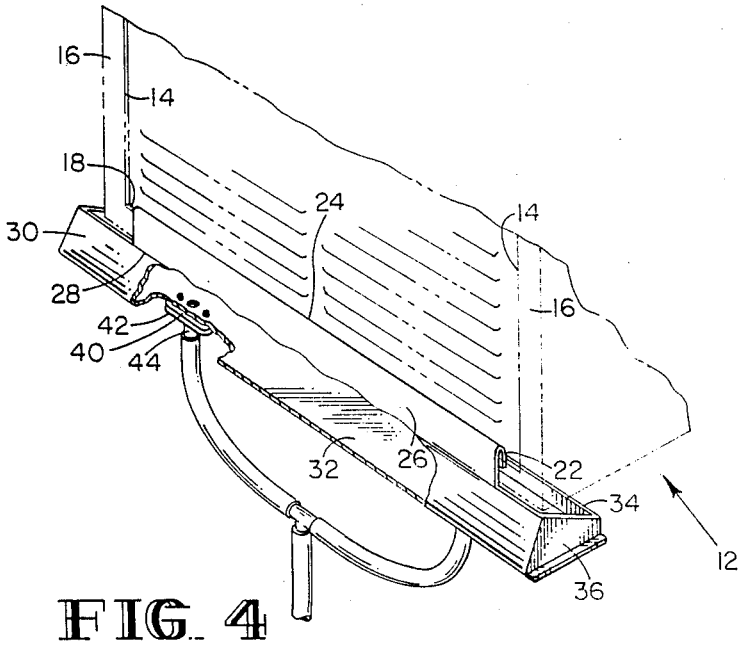
FIG. 4 is a rear perspective view of the apparatus in place on the sleeve of the air conditioning unit, showing an optional embodiment with two drains.

Once installed, the chassis can be repositioned into sleeve 12 through wall opening or window. While FIG. 2 shows the present apparatus protruding below, the scale of the present apparatus really does not add a cause for concern, namely, that the air conditioning unit will no longer fit. The present apparatus protrudes only about one-half inch (½") below the sleeve bottom 20; this is relatively small and is located away from the portions of the sleeve bottom 20 which rest on supporting frame work, either in the window or in the sleeved wall opening where the apparatus is installed.

When the device is installed, any excess condensate flows into the trough and is diverted away from the house or other structure to reduce damage. If sufficient clearance is available, the condensate can be dripped through the nipple 44. If clearance is poor, the condensate can be collected and delivered into a small tubing connected to the nipple for water removal. Once installed, it can be left indefinitely and may well outlast the air conditioning unit.

The trough is provided with some water capacity; that is, it can collect and hold a small quantity of water. There is always the risk of plugging at the drain opening, and to this end, the preferred embodiment is furnished with multiple drain openings to reduce the risk of total plugging and the consequential overflow. If plugging does occur, servicing the present apparatus can be easily accomplished by demounting it in the fashion described above. While the foregoing instrument is drawn to the preferred embodiment, the scope thereof is determined by the claims which follow.

We claim:

1. A retrofit attachment for a window or wall mounted air conditioner unit wherein the air conditioner unit is constructed with a surrounding sleeve and forms condensate therein which travels over a sleeve bottom and which is provided with heat rejection means through one end and that end includes an opening formed with a lip parallel to the sleeve bottom, said lip defining the lower border of an opening, an attachment which comprises:

an elongated trough fitting under the sleeve bottom at one edge thereof to catch condensate dripping therefrom, said trough being supported by an overhead holding means for holding the trough in a fixed relationship to the sleeve bottom; and further including means for draining said trough of condensate collected therein through an opening which directs the flow away from the supporting structure on which the air conditioning sleeve is installed.

2. The apparatus of claim 1 wherein said holding means comprises a "U" shaped hook means reaching up and over the edge of the lip above the sleeve bottom.

3. The apparatus of claim 2 wherein said hook means comprises a "U" shaped folded metal or plastic member for engaging the lip of the sleeve opening.

4. The apparatus of claim 3 wherein said hook-shaped member includes a lengthwise extent slightly less than the width of the sleeve opening to provide full width engagement.

5. The apparatus of claim 4 wherein said hook means comprises a pair of approximately parallel sheet members which are folded approximately 180°, and one is longer than the other, and the longer terminates at said trough.

6. The apparatus of claim 5 wherein said drain means includes an opening in said trough, and adjacent seal members surrounding said opening.

7. The apparatus of claim 1 wherein said trough is longer than the width of the sleeve bottom.

8. The apparatus of claim 7 wherein said holding means is shorter than an opening in the air conditioner.

9. The apparatus of claim 8 wherein said holding means includes two parallel sheet members folded 180°.

10. The apparatus of claim 9 wherein said holding means includes a lengthwise bend of about 20° to 40° to support said trough.

11. A retrofit drainage attachment for installation on a lip of a sleeve, the sleeve for containing a through-the-wall mounted air conditioning unit therein, the lip of the sleeve defining an enclosure on the bottom of the sleeve, the enclosure for capturing excess liquid condensate thereon and capable of channeling the condensate for drainage at the lip, the attachment comprising:

a trough member comprising a front wall member, a floor, and a rear wall member, said front wall member, floor, and rear wall member being constructed from a single flat stock sheet of metal, said front wall member, floor, and rear wall member dimensioned such that said front wall member meets in seamless relation said floor at approximately 50° to 70° angle and said rear wall meets in seamless relation said floor at approximately 90° angle, said trough member being about 27-5/16 inches long and about ½ inch deep, and further containing as part thereof a right end wall and a left end wall, said end walls fashioned from the same flat stock of sheet of metal as the aforesaid front wall, floor, and rear wall and dimensioned to define the distal ends of said trough member, said end pieces meeting said front wall, floor and rear wall at waterproof joints;

a support member comprised of a generally "U" shaped sheet of metal, said support member being formed from the same single flat stock sheet of metal that formed said front wall member, floor, rear wall member, and end walls, said support member with a facing wall and a support wall, said facing wall being a continuation of said front wall of said trough member and meeting said front wall at an obtuse angle thereto, said support wall being a continuation of said facing wall, bent over generally at 180° thereto and providing thereby a hook from which the attachment is suspended;

a drain, said drain comprising a spout and seal surrounding a hole in said floor of said trough member and located closer to said front wall member than to said rear wall member, said drain for allowing the condensate collecting in said trough member to fall away from the outside wall on which the of the air conditioner unit is mounted, or to be channeled into a drainage system.

* * * * *